US006314758B1

(12) United States Patent
Fukasawa

(10) Patent No.: US 6,314,758 B1
(45) Date of Patent: Nov. 13, 2001

(54) DOUBLE-PURPOSE EARLOBE ORNAMENTS USABLE AS STUD AND EARRING

(75) Inventor: Noboru Fukasawa, Kofu (JP)

(73) Assignee: Proje Co., Ltd., Yamanashi (JP)

( * ) Notice: Subject to any disclaimer, the term of this patent is extended or adjusted under 35 U.S.C. 154(b) by 0 days.

(21) Appl. No.: 09/526,937

(22) Filed: Mar. 16, 2000

(30) Foreign Application Priority Data

Dec. 8, 1999 (JP) ..... 11-349337

(51) Int. Cl.[7] ..... A44C 7/00
(52) U.S. Cl. ..... 63/12; 63/13; 63/14.1
(58) Field of Search ..... 63/12, 13, 14.1, 63/14.4, 14.5

(56) References Cited

U.S. PATENT DOCUMENTS 782,313 * 2/1905 Zirinsky ..... 63/12
2,959,039 * 11/1960 Jefferies ..... 63/14.5
3,595,031 * 7/1971 Weimer ..... 63/14.5
4,003,216 * 1/1977 Cecere et al. ..... 63/12
5,048,311 * 9/1991 Mastrobuono ..... 63/12
5,433,089 * 7/1995 Timbal ..... 63/12
5,487,280 * 1/1996 D'Amore, Jr. ..... 63/12

* cited by examiner

*Primary Examiner*—B. Dayoan
*Assistant Examiner*—Andrea Chop
(74) *Attorney, Agent, or Firm*—Richard M. Goldberg

(57) ABSTRACT

A double-purpose earlobe ornament usable as stud and earring comfortable to wear comprises an earlobe-support 1 adapted to come in contact with the outer side 9 of the earlobe that is provided in the upper part of an ornamental piece 7, an earlobe-holder 6 adapted to elastically come in contact with a spot on the inner side of the earlobe corresponding to the earlobe-support 1 that is provided in the lower part of the ornamental piece 7 so as to be elastically turned upright, the earlobe-support 1 being shaped flat in the upper portion thereof and gently curved away from the outer side of the earlobe in the lower portion thereof and having an opening 5 extending over part or the whole of the gently curved portion, a piercing pin 3 provided at the back of the opening 5 so as to be rotatable when passed through the opening 5, the piercing pin 3 being adapted to pass through the earlobe-holder 6 turned upright and extend from the outer side to the inner side of the earlobe substantially at right angles to the earlobe-support 1 on coming in contact with the upper end of the opening 5.

9 Claims, 5 Drawing Sheets

DOUBLE-PURPOSE EARLOBE ORNAMENTS USABLE AS STUD AND EARRING

BACKGROUND OF THE INVENTION

This invention relates to double-purpose earlobe ornaments usable as stud (i.e. earrings for wearing in pierced earlobe) and earring.

Recently various designs of double-purpose earlobe ornaments that can be used both as a stud and an earring have been proposed. They are complex in structure. The piercing pin, in particular, must be designed to extend in a stable condition from the outer side of the earlobe to the inner side, lying substantially perpendicular to the earlobe-support, when used as a stud, whereas the earlobe-support must be designed to hang down when used as an earring.

FIG. 5(*a*) shows a double-purpose earlobe ornament on which the Applicant filed a utility model application No. 9318 with the Japanese Patent Office in 1996. This double-purpose earlobe ornament comprises an earlobe-support 1 situated in the upper part of an ornamental piece 7 for contact with the outer side 9 of the earlobe and an earlobe holder elastically pivoted to rotate up and down so as to elastically come in contact with the inner side of the earlobe corresponding to the earlobe-support on the outer side. A slit is provided near the lowest end of the earlobe-support 1 and a piercing pin 3 is rotatably mounted behind the slit. The pin 3 is designed to pass through an earlobe-holder 6 that is turned upright and pierce from the outer side to the inner side of the earlobe on coming in contact with the upper end of the slit, lying at right angles to the earlobe-support 1 (as indicated by the dotted line in FIG. 5(*a*).

Designs of the above type usually use a flat sheet of metal as the earlobe-support 1. When in contact with the outer side 9 of the earlobe, the earlobe-support 1 of this type forms a sharply defined boundary between the area of the earlobe in contact therewith and the area out of contact. This causes intense deformation of the muscle of the earlobe in the vicinity of the point of contact, as shown in FIG. 6(*a*), that causes discomfort to the wearer.

The object of this invention is to provide double-purpose earlobe ornaments usable as stud and earring without the shortcomings of the conventional designs that cause discomfort to the wearer.

SUMMARY OF THE INVENTION

To solve the problem described above, a double-purpose earlobe ornament usable as stud and earring according to this invention comprises an earlobe-support adapted to come in contact with the outer side of the earlobe that is provided in the upper part of an ornamental piece, an earlobe-holder adapted to elastically come in contact with a spot on the inner side of the earlobe corresponding to said earlobe-support that is provided in the lower part of the ornamental piece so as to be elastically turned upright, the earlobe-support being shaped flat in the upper portion thereof and gently curved away from the outer side of the earlobe in the lower portion thereof and having an opening extending over part or the whole of said gently curved portion, a piercing pin provided at the back of the opening so as to be rotatable when passed through said opening, the piercing pin being adapted to pass through the earlobe-holder turned upright and extend from the outer side to the inner side of the earlobe substantially at right angles to the earlobe-support on coming in contact with the upper end of the opening.

DETAILED DESCRIPTION OF THE INVENTION

As described above and shown in FIGS. 1(*a*) and 1(*b*), the basic feature of earlobe-supports according to this invention is that the lower end thereof is gently curved away or bent back from the outer side of the earlobe and an opening extending over a part or the whole of said curved or bent back portion is provided.

Figure 1:
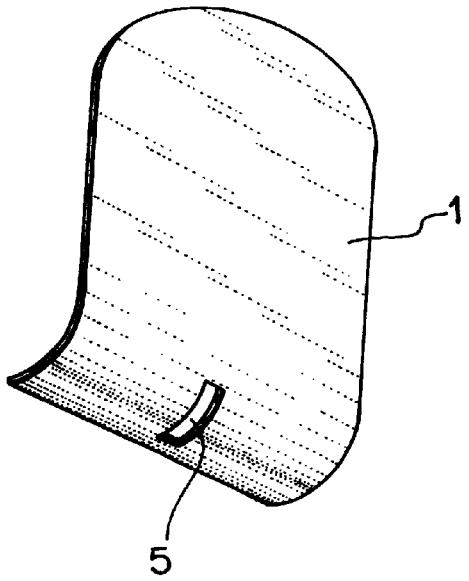
FIG. 1 shows perspective views of basic structures of the earlobe-support according to this invention. 1(*a*) shows one having an opening that does rot extend to the lower end thereof, while 1(*b*) shows one having an opening that extends to the lower end thereof.
Figure 1:
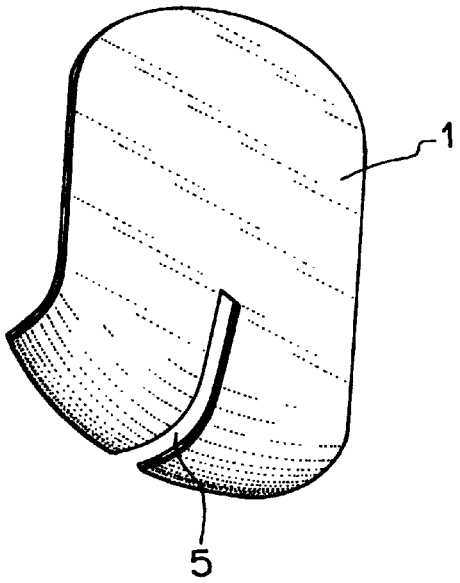

FIG. 1(*a*) shows an earlobe-support 1 having an opening 5 that does not extend to the lower end thereof, whereas FIG. 1(*b*) shows an earlobe-support 1 having an opening 5 that extends to the lower end thereof. The opening 5 shown in FIG. 1(*a*) extends over a part of the curved portion, whereas the opening 5 shown in FIG. 1(*b*) extends over the whole of said curved portion.

The upper end of the opening 5 shown in FIG. 1(*a*) is situated inside the curved portion, whereas the upper end of the opening 5 shown in FIG. 1(*b*) extends to a flat portion above the curved portion.

Figure 2:
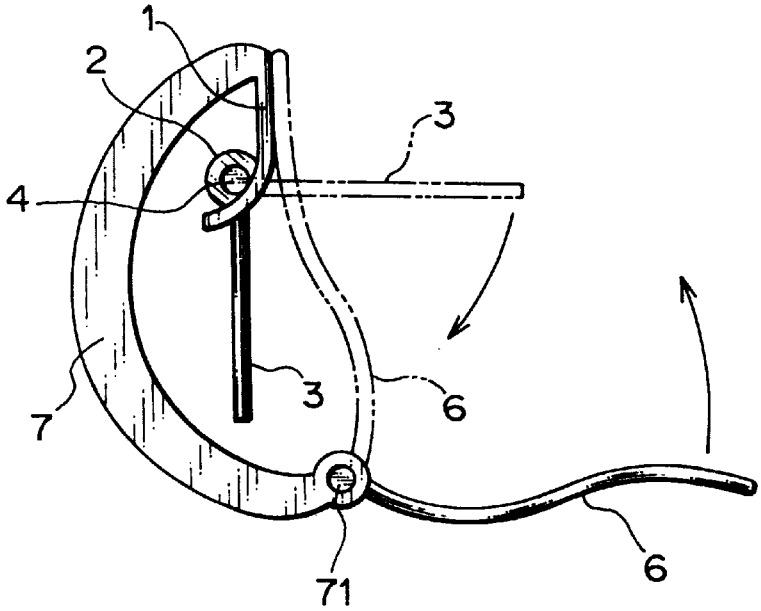
FIG. 2 shows side elevations showing how the earlobe-holder and piercing pin move. 2(*a*) corresponds to FIG. 1(*a*), while 2(*b*) corresponds to FIG. 1(*b*).
Figure 2:
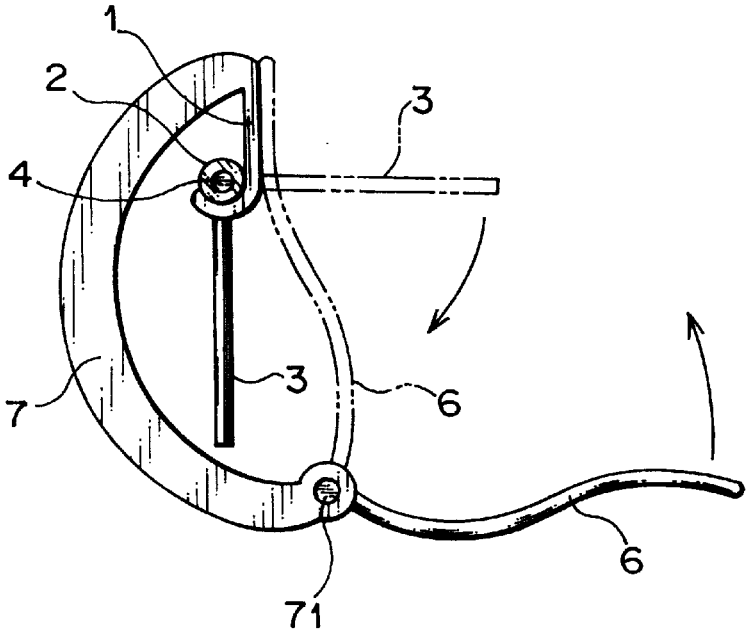

FIGS. 2(*a*) and 2(*b*) show the earlobe-supports 1, shown in FIGS. 1(*a*) and 1(*b*). The solid line shows the earlobe-holder 6 detached from the earlobe-support 1 and the piercing pin 3 dangling, whereas the dotted line shows the earlobe-holder 6 elastically held in contact with the outer surface of the earlobe-support 1 and the piercing pin 3 raised to extend from the outer side to the inner side of the earlobe, lying substantially perpendicular to the earlobe-support. Earlobe-holder 6 is mounted to the lower end of ornamental piece 7 at bearing 71.

When the earlobe-holder 6 is elastically held in contact with the outer surface of the earlobe-support 1 and the piercing pin 3 is raised to lie substantially perpendicular to the earlobe-support (as indicated by the dotted line), the double-purpose earlobe ornament can be used as a stud. When the piercing pin is hung (as indicated by the solid line), the double-purpose earlobe ornament can be used as an ordinary earring.

Although the opening 5 shown in FIG. 1 is a slit, the shape of the opening 5 is not particularly limited. The opening 5 may be of any shape so long as the piercing pin 3 passed therethrough can rotatably move therethrough.

Figure 6:
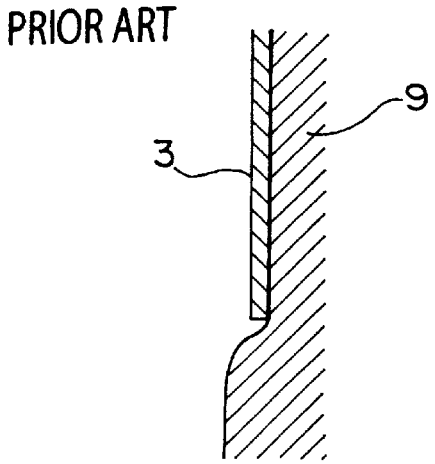
FIG. 6 shows cross-sectional views of earlobe-supports held in contact with the outer side of the earlobe. 6(*a*) shows a conventional design, while 6(*b*) shows a design according to this invention.
Figure 6:
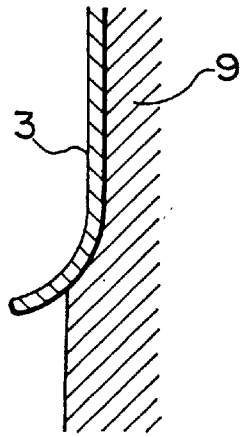

The earlobe-support according to this invention is gently curved away from the outer side of the earlobe with which the earlobe-support is held in contact. Accordingly, even when the earlobe-support 1 is held in contact with the outer side 9 of the earlobe by the elastic force of the earlobe-holder 6, the contour of the earlobe in the boundary between the area in contact with the earlobe-support 1 and the area out of contact therewith changes gently as shown in FIG. 6(*b*), not as abruptly as shown in FIG. 6(*a*). Because of this, the double-purpose earlobe ornaments according to this invention can be used as either stud or earring without causing pain or discomfort to the wearer.

EMBODIMENTS

Now embodiments of this invention are given below.

[Embodiment 1]

Figure 3:
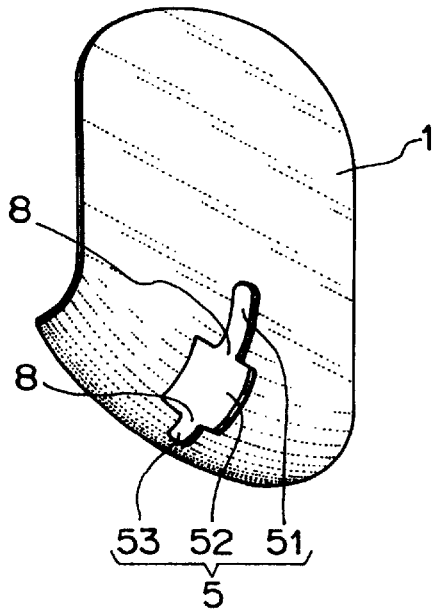
FIG. 3 shows perspective views of an embodiment. 3(*a*) shows an opening having no special design consideration in the boundaries between the narrow upper and lower portions and the wider middle portion thereof, while 3(*b*) shows an opening having an opening whose width is slightly greater than the diameter of the piercing pin so as to permit the piercing pin to move therethrough.
Figure 3:
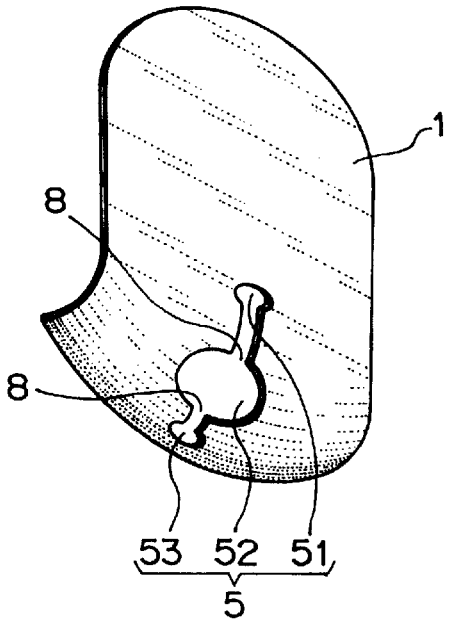

A first embodiment of this invention has an opening 5 that consists of a narrow upper portion 51 and a narrow lower portion 53, with a wider middle portion 52 therebetween, as shown in FIG. 3(*a*).

To mount a piercing pin 3 on the back side of the earlobe-support 1 by way of a bearing 2, the pin 3 integral with the bearing 2 must be passed from the outer side of the earlobe-support 1 to the inner side thereof through the opening 5. Then, the rotating shaft 4 of the piercing pin must be mounted in the bearing 2 situated at the back of the earlobe-support 1. The wider middle portion provided in the opening 5 of the first embodiment facilitates the passing of the piercing pin and the whole assembling work.

In an embodiment shown in FIG. 3(*b*), the width of the boundaries 8 between the narrow upper and lower portions 51 and 53 and the wider middle portion 52 is substantially equal to or only slightly greater than the diameter of the piercing pin 3 so as not to prevent the movement of the sliding pin 3 therethrough.

When the earlobe ornament of this design is used as a stud, the piercing pin 3 is passed into the narrow upper portion 51. However, the piercing pin 3 does not fall into the wider middle portion 52 through the boundary 8 because of the relationship between the width of the boundary 8 and the diameter of the piercing pin 3. This permits the earlobe ornament to be used as a stud in a stable condition.

When the earlobe ornament of this design is used as an earring, the piercing pin 3 is passed into the narrow lower portion 53. However, the piercing pin 3 does move into the wider middle portion 52 because of the relationship between the width of the boundary 8 and the diameter of the piercing pin 3. This permits the earlobe ornament to be used as an earring in a stable condition. In addition, the piercing pin dangling in a stable condition does not injure the earlobe.

[Embodiment 2]

Figure 4:
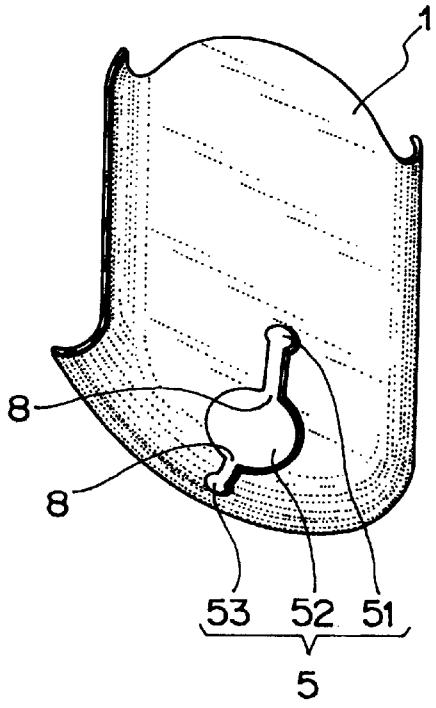
FIG. 4 shows a perspective view of a second embodiment. 4(*a*) shows an earlobe-support whose both sides are curved, while 4(*b*) shows an earlobe-support whose top and bottom are curved.
Figure 4:
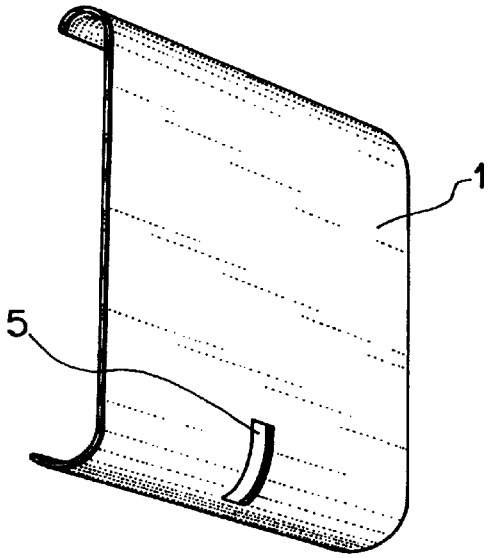
Figure 5:
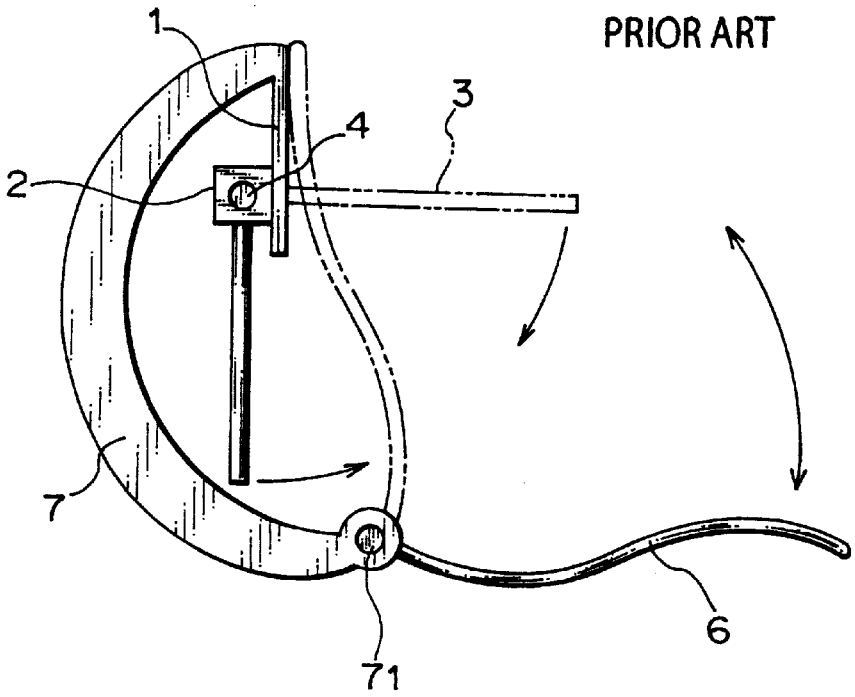
FIG. 5(*a*) shows a side elevation of a conventional double-purpose earlobe ornament usable as stud and earring devised by the Applicant.

A second embodiment of this invention has an earlobe-support 1 that is gently curved away from the outer side of the earlobe not only in the lower part, but also on both sides thereof as shown in FIG. 4(*a*) and in the upper part as well as shown in FIG. 4(*b*). While FIGS. 4(*a*) and 4(*b*) show earlobe-supports whose both sides and top and bottom ends are individually gently curved away from the outer side of the earlobe, both designs may be combined in one earlobe-support, as well.

The second embodiment that is gently curved away from the outer side of the earlobe not only in the lower part, but also on both sides thereof and in the upper part as well causes the surface of the earlobe 9 with which the earlobe-support is held in contact to change its contour gently. This assures a comfortable use of the earlobe ornament as stud or earring.

EFFECTS OF THE INVENTION

As is evident from the above, the earlobe ornaments according to this invention not only provide convenience of use as stud and earring but also assure comfort of the wearer.

The first embodiment facilitates the assembling operation and assures fitting in a stable condition, whereas the second embodiment provides still greater comfort in use.

Thus, the double-purpose earlobe ornaments according to this invention have many advantages and are of great value.

What is claimed is:

1. A double-purpose earlobe ornament usable as a stud and earring, comprising:

an ornamental piece, a board shaped earlobe-support adapted to come in contact with an outer surface of an earlobe and which is connected with an upper part of the ornamental piece, the board shaped earlobe-support being shaped flat in an upper portion thereof and gently bending back in a lower portion thereof in a direction toward said earlobe-support, and the earlobe-support having an opening extending over at least part of said gently bent back portion, an earlobe-holder adapted to elastically come in contact with a spot on an inner surface of the earlobe corresponding to said earlobe-support and which is connected with a lower part of the ornamental piece so that the earlobe-holder can be elastically turned upright, the earlobe-support extending from the ornamental piece in a direction generally towards the connection of the ornamental piece with the earlobe holder, and a piercing pin provided at a back of the opening so as to be rotatable through said opening, the piercing pin being adapted to pass through the earlobe-holder turned upright and extend from the outer surface to the inner surface of the earlobe substantially at right angles to the earlobe-support on coming in contact with an upper end of the opening.

2. A double-purpose earlobe ornament usable as a stud and earring according to claim 1, in which the opening is spaced from a lower end of the earlobe-support so that the opening does not extend to the lower end of the earlobe-support.

3. A double-purpose earlobe ornament usable as a stud and earring according to claim 1, in which the opening extends to a lower end of the earlobe-support.

4. A double-purpose earlobe ornament usable as a stud and earring according to claim 1, in which upper and lower portions of the opening are narrow so as to have a first width and a middle portion therebetween is wider than said first width of said upper and lower portions.

5. A double-purpose earlobe ornament usable as a stud and earring according to claim 4, in which boundaries between the narrower upper and lower portions and the wider middle portion having a width substantially equal to a diameter of the piercing pin so as not to prevent movement of the piercing pin therethrough.

6. A double-purpose earlobe ornament usable as a stud and earring according to claim 4, in which boundaries between the narrower upper and lower portions and the wider middle portion having a width only slightly greater than a diameter of the piercing pin so as not to prevent movement of the piercing pin therethrough.

7. A double-purpose earlobe ornament usable as a stud and earring according to claim 1, in which the earlobe-support has opposite sides and both sides of the earlobe-support are gently bent back toward said ornamental piece.

8. A double-purpose earlobe ornament usable as a stud and earring according to claim 7, in which the earlobe-support has an upper side which is gently bent back toward said ornamental piece.

9. A double-purpose earlobe ornament usable as a stud and earring according to claim 1, in which the earlobe-support has an upper side which is gently bent back toward said ornamental piece.

* * * * *